US007461534B2

(12) United States Patent
Bridgland

(10) Patent No.: US 7,461,534 B2
(45) Date of Patent: Dec. 9, 2008

(54) TOOL TO MANIPULATE WROUGHT IRON

(76) Inventor: Kerry Gilbert Bridgland, 23 Elizabeth Street, Aitkenvale, QLD (AU) 4814

( * ) Notice: Subject to any disclaimer, the term of this patent is extended or adjusted under 35 U.S.C. 154(b) by 0 days.

(21) Appl. No.: 11/640,190

(22) Filed: Dec. 18, 2006

(65) Prior Publication Data

US 2007/0157697 A1 Jul. 12, 2007

(30) Foreign Application Priority Data

Jan. 11, 2006 (AU) ..... 2006200092

(51) Int. Cl.
*B21D 37/01* (2006.01)
*B21C 47/00* (2006.01)

(52) U.S. Cl. ..... 72/462; 72/147

(58) Field of Classification Search ..... 72/147, 72/149, 462, 463, 467, 468, 469, 470, 295, 72/301, 303, 306
See application file for complete search history.

(56) References Cited

U.S. PATENT DOCUMENTS

| | | | | | |
|---|---|---|---|---|---|
| 217,870 | A * | 7/1879 | Groshans | 72/149 |
| 533,513 | A * | 2/1895 | Weed | 72/147 |
| 560,239 | A * | 8/1896 | Stewart | 72/147 |
| 664,771 | A * | 12/1900 | McCallum | 72/147 |
| 797,287 | A * | 8/1905 | Jewett | 72/147 |
| 805,231 | A * | 11/1905 | Pembroke | 72/147 |
| 1,731,087 | A * | 10/1929 | Zatti | 72/155 |
| 1,899,281 | A * | 2/1933 | Lidseen | 72/157 |
| 2,822,023 | A * | 2/1958 | Ahern | 72/20.3 |
| 3,020,949 | A * | 2/1962 | Garcia | 72/166 |
| 3,332,267 | A * | 7/1967 | Allison | 72/147 |
| 3,487,676 | A * | 1/1970 | Marietta et al. | 72/477 |
| 4,522,055 | A * | 6/1985 | Berger | 72/477 |
| 5,463,888 | A * | 11/1995 | Nagai | 72/157 |
| 5,495,739 | A * | 3/1996 | Beecher | 72/146 |
| 6,487,889 | B1 * | 12/2002 | Bates et al. | 72/459 |

* cited by examiner

*Primary Examiner*—Derris H. Banks
*Assistant Examiner*—Teresa Bonk
(74) *Attorney, Agent, or Firm*—Hoffman, Wasson & Gitler, P.C.

(57) ABSTRACT

A tool to manipulate wrought iron has a face and at least one side wall, the face being provided with a raised portion, the outer periphery of the raised portion providing a bending surface for wrought iron, the raised portion further containing a recess adapted to trap an end of the wrought iron, the side wall being provided with a recess adapted to accommodate a portion of the wrought iron.

8 Claims, 7 Drawing Sheets

TOOL SIDE VIEW

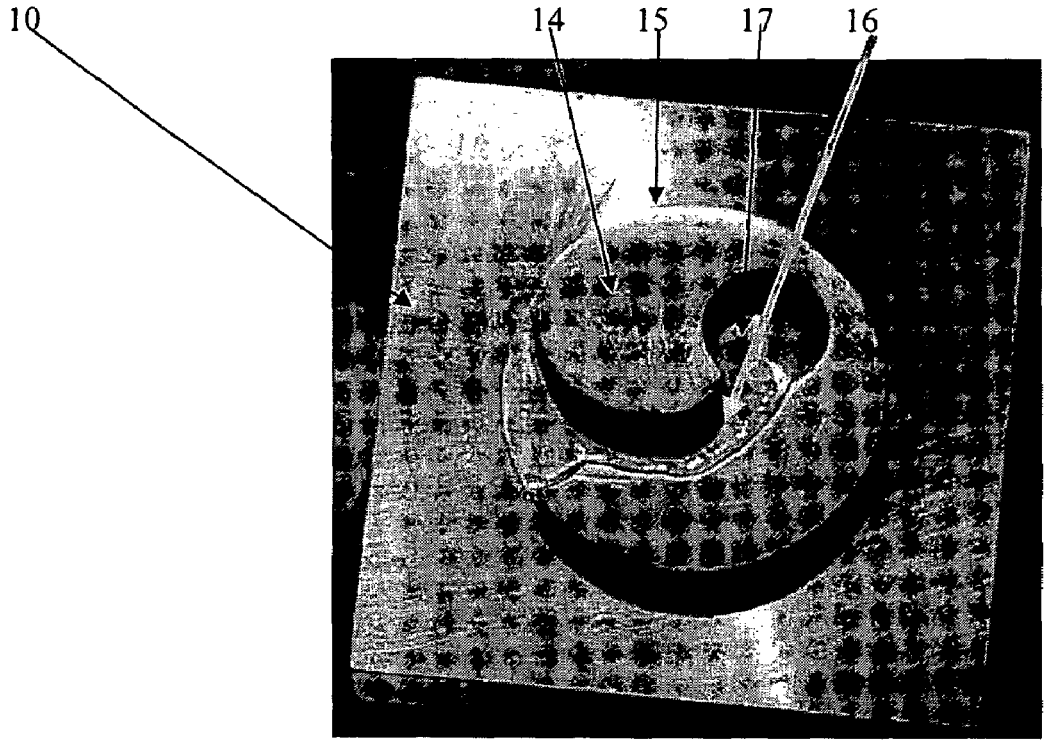
FIG 1 TOOL TOP VIEW
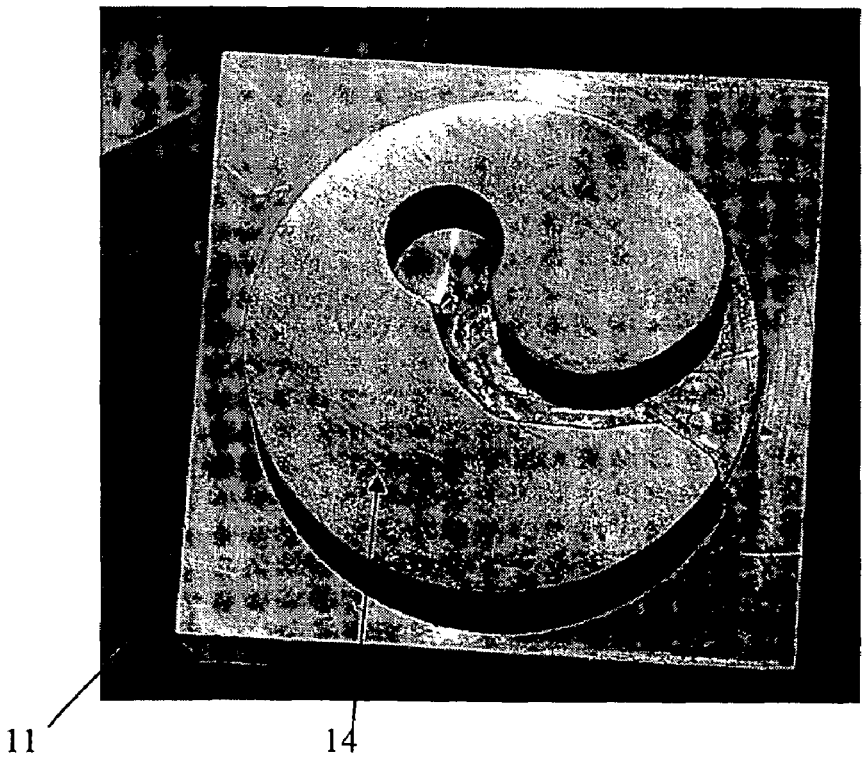
FIG 2 TOOL BOTTOM VIEW

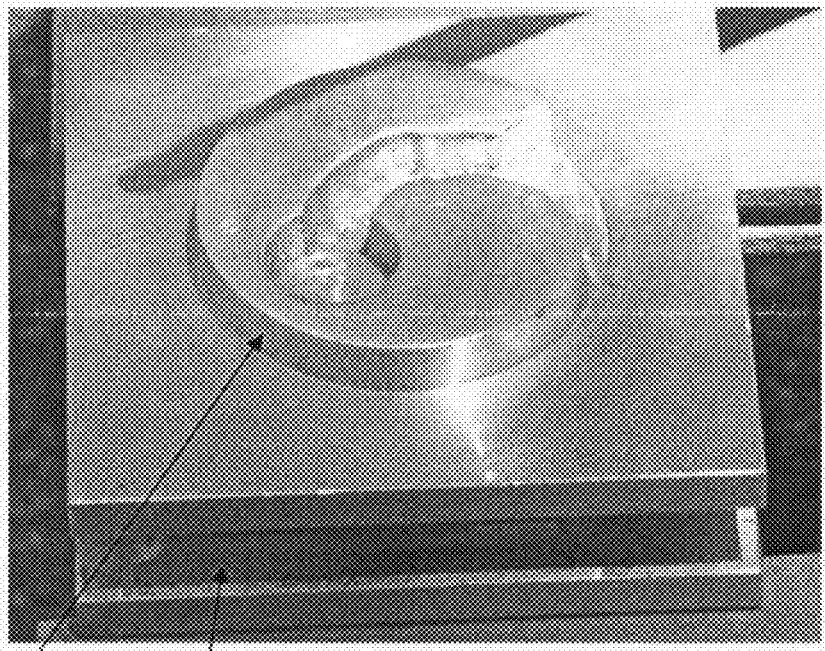
FIG 3 TOOL PERSPECTIVE VIEW
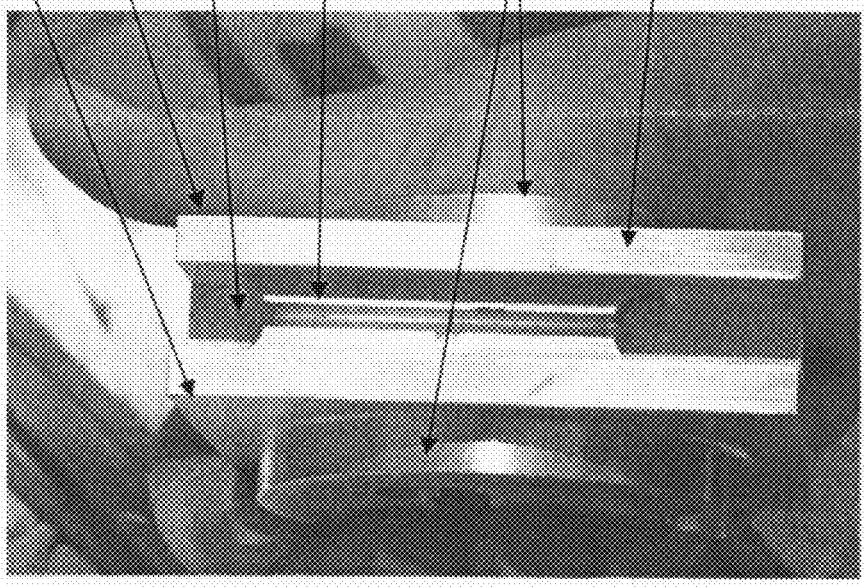
FIG 4 TOOL SIDE VIEW

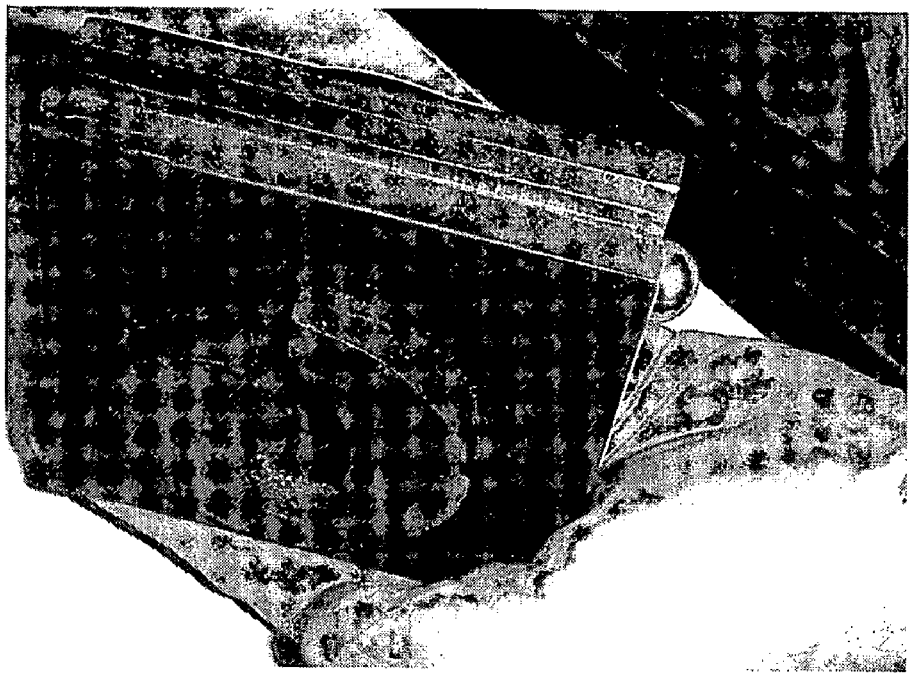
FIG 5 TOOL SIDE VIEW
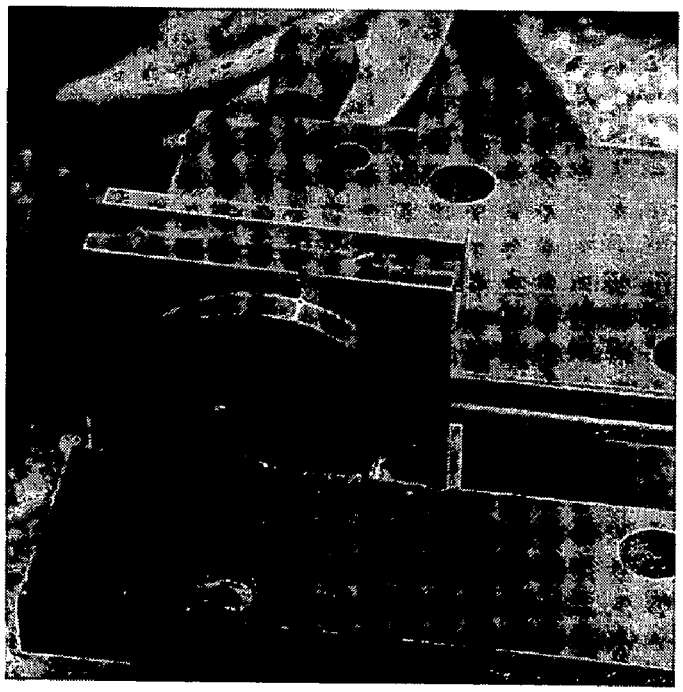
FIG 6 TOOL CLAMPED IN POSITION

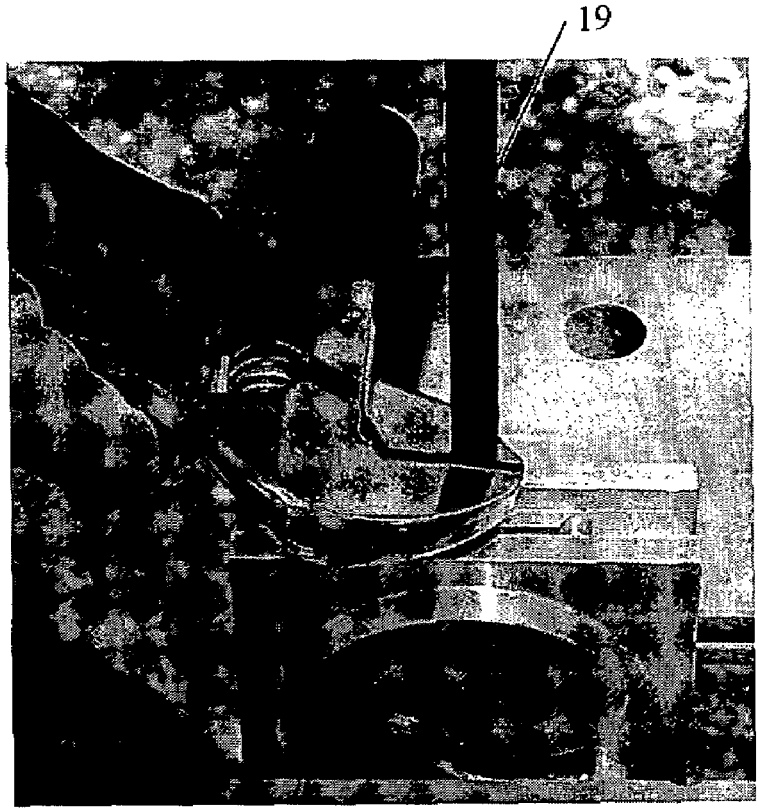
FIG 7 TWISTING IRON END
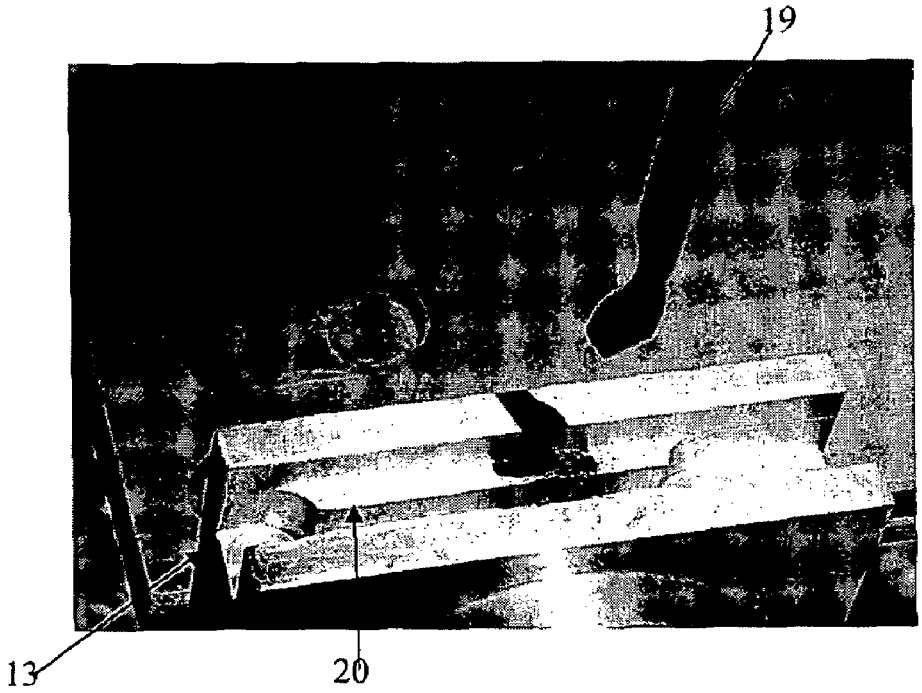
FIG 8 TWISTING IRON END

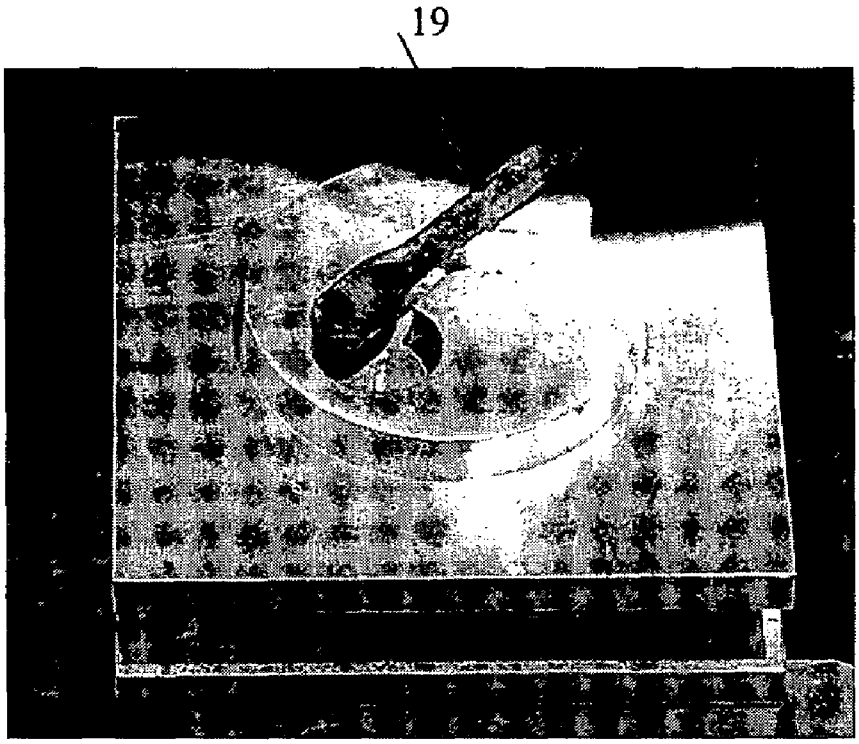
FIG 9 CURVING IRON STEP 1
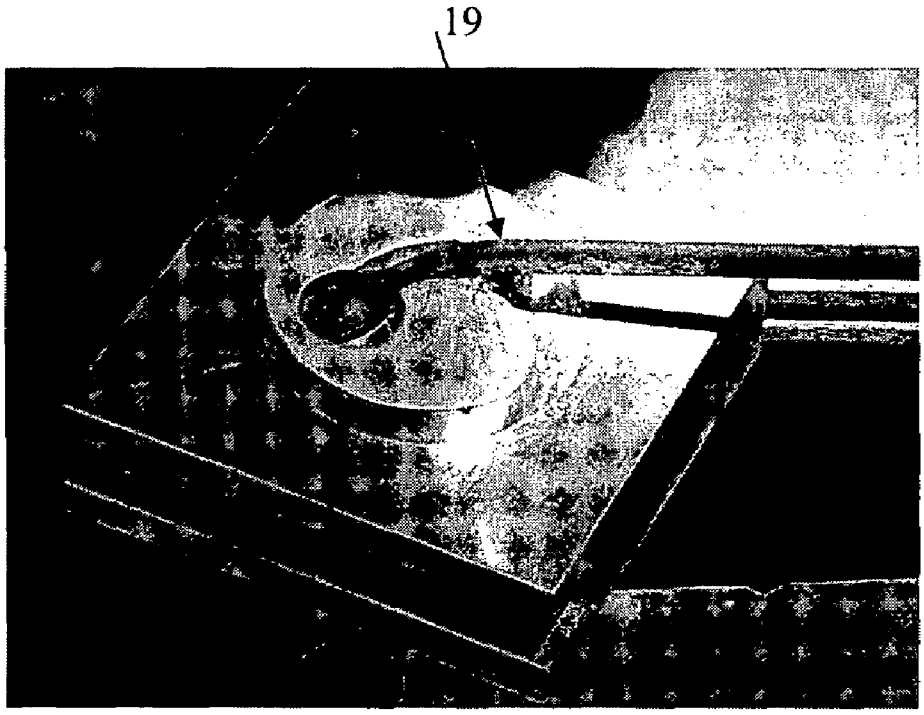
FIG 10 CURVING IRON STEP 2

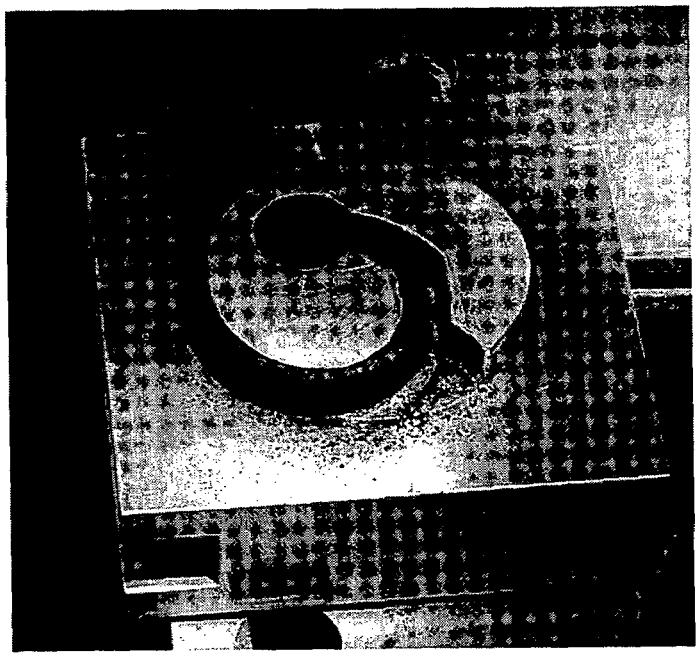
FIG 11 CURVING IRON STEP 3
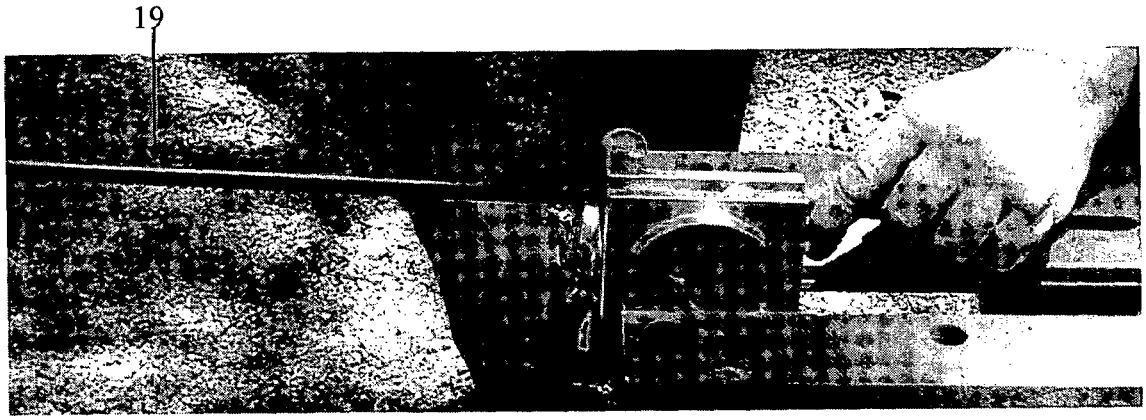
FIG 12 TWISTING IRON MIDDLE

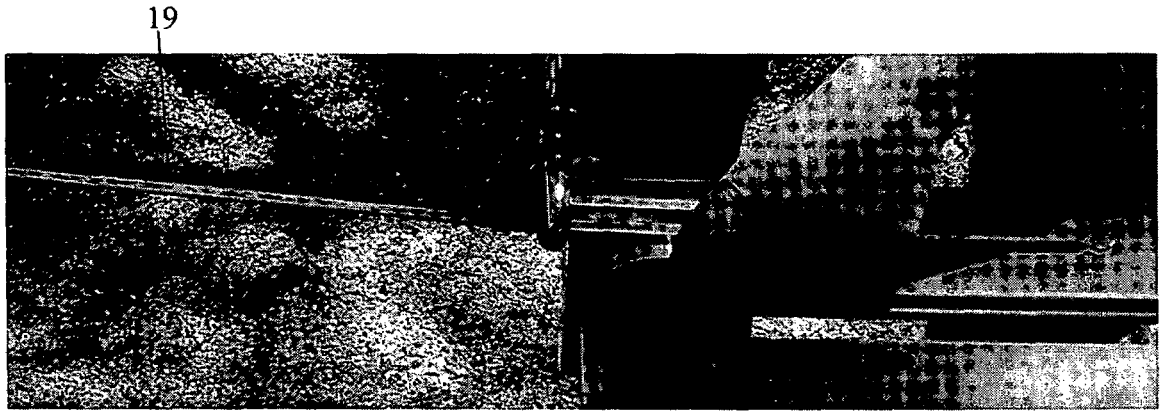
FIG 13 TWISTING IRON MIDDLE
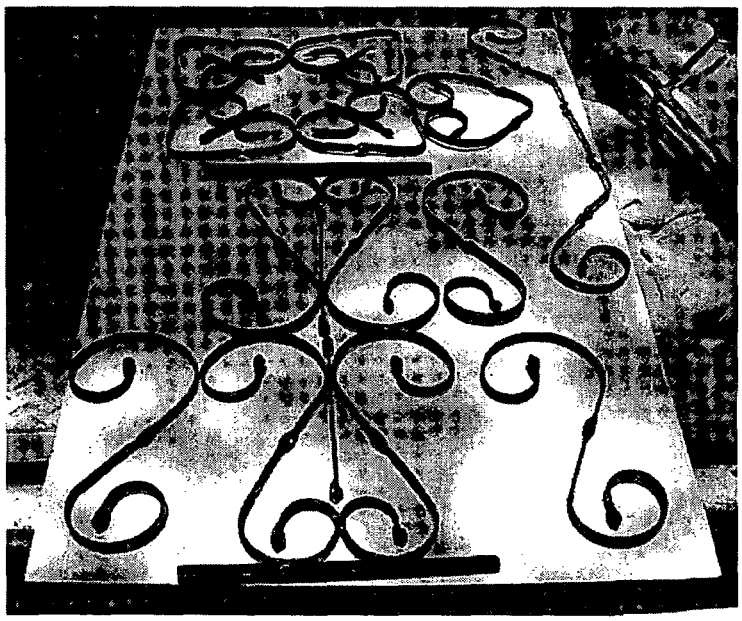
FIG 14 FINISHED PRODUCTS

TOOL TO MANIPULATE WROUGHT IRON

FIELD OF THE INVENTION

This invention is directed to a simple tool with no moving parts and which can be used to quickly and accurately make twists and turns into wrought iron or other material in which is desired to make twists and turns.

BACKGROUND OF THE INVENTION

Wrought iron is a somewhat confusing term that refers to both a type of metal and a process of formation. More traditionally, wrought iron is a variety of iron, with additives that make it twistable with a low corrosion rate. Often, the term "wrought iron," refers to a forged (not truly wrought) iron that resembles the former in appearance, but is made out of steel. This decorative iron creates reproductions for patio furniture, window screens, and custom fencing.

Authentic wrought iron differs from steel in that it is impregnated with tiny slivers of iron silicate known as "slag." When distributed as fibres, the slag changes the chemical properties of the iron enough to create a new and beneficial metal. Wrought iron is valued for strength under tensile pressure, resistance to corrosion, malleability, and how well it keeps a finish. Most metals, when corroding, exhibit ugly patches of discolored rust. But wrought iron distributes the rust into a beautiful dappled coppery or brownish finish that appeals to people's sense of age.

In the design world, "wrought iron" increasingly refers to a style of metalwork that hearkens back to the heyday of scrolls and curlicues from the Iron Age through Medieval times and into the Protestant Reformation. These ornamental items are distinguished by their twists and turns that give them an attractive shape. Inexpensive accessories, such as candleholders, lamps, and plant stands decorate many contemporary homes.

Wrought iron typically contains:

(1). Iron, alloyed (combined) with, (2). Less than 0.03% carbon.

True wrought iron forges well, can be easily bent hot or cold and can be welded. "Wrought iron" is currently used to refer to almost any malleable low carbon steel.

In order to form decorative twists and curves in wrought iron plate or rod, it is quite important to provide consistency in the twisting and the radius of the curve such that the finished product is aesthetically appealing. Thus, incomplete twists, or curves with different radii can provide a product which is not very visually appealing.

It is known to curve or twist wrought iron rods or plates using a hammer and some form of anvil. However, this requires a high degree of accuracy and expertise in order to provide consistency in the curve radii and the like.

The present invention is directed to a simple tool which does not need any moving parts and which has a particular design to enable iron rods or plates (typically about 10 mm) to be accurately and repeatedly able to be twisted or curved. FIG. 14 of the present invention illustrates an array of products that can be obtained using the tool which is the subject of the present invention.

It will be clearly understood that, if a prior art publication is referred to herein, this reference does not constitute an admission that the publication forms part of the common general knowledge in the art in Australia or in any other country.

BRIEF SUMMARY OF THE INVENTION

It is an object of the invention to provide a tool to manipulate wrought iron and particularly to enable twists and turns to be made into rods or plates of wrought iron, and which may overcome some of the above-mentioned disadvantages or provide a useful or commercial choice.

In one form the invention resides in a tool to manipulate wrought iron, the tool comprising a face and at least one side wall, the face being provided with a raised portion, the outer periphery of the raised portion providing a bending surface for wrought iron, the raised portion further containing a recess adapted to trap an end of the wrought iron, the side wall being provided with a recess adapted to accommodate a portion of the wrought iron.

In a broader form, the invention resides in a tool to enable twists and curves to be formed into a material such as wrought iron, the tool containing various stations, each station enabling a different manipulation to be made to the material, at least one station enabling the material to be twisted, and another station enabling the material to be curved.

In this manner, the design of the tool enables lengths of wrought iron to be twisted or curved into various decorative shapes. In particular, the design of the tool enables the end of the wrought iron to be twisted, and/or an intermediate portion of the wrought iron to be twisted, and enables part of the wrought iron to be curved.

In order to provide curves of different radii, it is desired that the tool contains a pair of faces, each face containing the raised portion, with the raised portion on one face having a different radii than the raised portion on the other face. It is therefore preferred that the tool contains a top face and a bottom face each with a raised portion. Of course, the tool could be in the form of a cube in which case the face can be a top face and a side face, or a pair of side faces and the like.

The tool can be made of any suitable material and a suitable material is aluminium, although the tool can also be made of steel or other materials. The tool may be made of composite materials such as aluminium with steel sleeves in regions of increased wear and the like.

The tool can be of any size or shape, but to make the tool portable and handy, it is found that decorative twists and turns can be made in wrought iron rods or plates of between 5-20 mm using a tool that is compact enough to be held in a person's hand. Thus, it is found that a very large tool (which increases manufacturing costs) does not seem to be required.

In order to make the tool handy to use, and able to be clamped when required, it is preferred that the tool is substantially rectangular when viewed in plan and when viewed in elevation. The tool will typically have a pair of opposed faces, which can be conveniently called a top face and a bottom face, and these can be rectangular, circular, oval, triangular or have irregular faces. If the faces are rectangular, a typical length will be between 5-30 cm and a typical width will also be between 5-30 cm.

It is envisaged that the tool will have a pair of opposed faces and these can be spaced apart by a distance of between 1-10 cm, and typically between 1-5 cm.

The tool will typically have a side wall between the opposed faces. If the faces are rectangular, the tool will have four sidewalls, and if the tool is cylindrical, there will be a single side wall. Typically, the tool will be substantially rectangular and therefore four sidewalls will be provided and the sidewalls will typically have a width of between 1-10 cm and typically between 1-5 cm.

At least one of these sidewalls should contain a recess or some form of means into which part of the wrought iron can be placed or trapped. The recess can be designed to locate an intermediate portion of the wrought iron and/or an end of the wrought iron.

It is preferred that the tool contains a recess to locate a wrought iron bar or strip, and a recess to trap the end of the wrought iron. The tool may contain a plurality of such recesses in any suitable combination. In one form, both of these recesses are formed one within the other. However, it is not considered that the invention should be limited to this particular arrangement.

The face of the tool is provided with a raised portion which can be seen as a boss. The raised portion can be formed by machining away material about the raised portion such that the raised portion can be formed integrally with the remainder of the tool. Alternatively, the raised portion can be formed separately and fixed to the tool such as by welding, fasteners and the like. The raised portion can be made of a single piece or several pieces that are assembled or put together.

The raised portion can be raised above the remainder of the face by a distance to provide a suitable bending surface. It is considered that a suitable distance will be between 5-30 mm although this can vary to suit.

The raised portion can have any suitable shape or size providing that it can provide a bending surface. Thus, the raised portion may be substantially curved or cylindrical, may be oval, may have corners, a combination of surfaces and the like.

The tool preferably contains a means to trap the wrought iron such that it can be bent about the bending surface on the raised portion. A simple way to achieve this is to provide a recess in the raised portion into which an end of the wrought iron can be positioned and the wrought iron can then be bent around the bending surface.

The tool can be used to bend any suitable type of material. Although one suitable type of material is wrought iron, and the tool will be described with reference to bending wrought iron, it should be appreciated that the tool could also be used to bend other types of metals, or even other types of bendable materials such as plastics, composite materials and the like.

BRIEF DESCRIPTION OF THE DRAWINGS

An embodiment of the invention will be described with reference to the following drawings in which:

FIG. 1 illustrates one face of the tool showing the raised portion.

FIG. 2 illustrates the other face of the tool showing a raised portion.

FIG. 3 illustrates a perspective view of the tool showing the side wall containing a recess.

FIG. 4 illustrates a side view of the tool more clearly showing the recess in the side wall.

FIG. 5 illustrates the tool and particularly how the tool is small enough to be supported in the person's hand.

FIG. 6 illustrates the tool clamped in position.

FIG. 7 illustrates how a strip of wrought iron can be twisted at its end by being inserted into the tool of FIG. 6.

FIG. 8 illustrates the end result showing the wrought iron with an end twist.

FIGS. 9-11 illustrate progressively how a strip of wrought iron can be curved using the raised portion on the face of the tool.

FIGS. 12-13 illustrate how a length of wrought iron can be twisted anywhere along its length by being inserted into the recess in the side wall.

FIG. 14 illustrates various decorative products that can be made using the tool of the present invention.

DETAILED DESCRIPTION OF THE INVENTION

Referring to the illustrations and initially to FIGS. 1-5 there is illustrated a simple tool having no moving parts and which can be used to bend and twist wrought iron simply and with great repeatability and accuracy.

Best illustrated in FIG. 4, the tool contains a top face 10, a bottom face 11, and a side wall 12 containing a recess 13. Of course, the term top face 10 and bottom face 11 can be used interchangeably, but will be mentioned for the sake of convenience.

Top face 10 (see FIG. 1) and bottom face 11 (see FIG. 2) have differently sized raised portions to provide different radii and height which helps to provide the various decorative shapes illustrated in FIG. 14. By having these faces on either side of the tool, this provides a convenient way to enable the wrought iron to be curved.

Each face contains a raised portion 14 which in the particular embodiment is substantially circular, and is formed by machining away the remainder of the face. Of course, there are other ways in which the raised portion can be made. The raised portion has a "height" sufficient allow the wrought iron bar or strip to be bent around the periphery of the raised portion and therefore the height will be typically between 5 mm-30 mm. The diameter of the raised portion can vary, but in the particular embodiment, is between 40-100 mm. The raised portion has a curved periphery 15 about which the wrought iron (or other product to be bent) can be bent.

To locate an end of the wrought iron, the raised portion contains an internal recess or passageway 16. Passageway 16 has an enlarged inner portion 17 and the reason for this will be explained in greater detail below, but is to accommodate a twisted end of the wrought iron.

Referring now to FIG. 4, the recess 13 will be described in greater detail. Recess 13 comprises a channel which extends across one side wall and is sufficiently wide and deep to accommodate a length of wrought iron (for instance as illustrated in FIGS. 12 and 13). However, in the particular embodiment, inside recess 13 is a smaller elongated slot 20 which has a much smaller width and is used to trap the end of the wrought iron which will be described in greater detail with reference to FIGS. 7 and 8.

FIGS. 6-8 illustrate the use of the tool to twist the end of a bar or strip of wrought iron. Initially, the tool is clamped into position (FIG. 6). Then, the end of a length of wrought iron 19 (typically 10 mm wide) is held in this smaller slot 20 (see FIG. 4). This is the position illustrated in FIG. 7. A wrench can then be used to twist, or form, a 90° twist (for instance) into the wrought iron 19, and the end of the wrought iron cannot move as it is held with slot 20. This forms a decorative twist in the end portion of th wrought iron and this is illustrated in FIG. 8.

FIGS. 9-11 illustrate how the wrought iron (or other material) can be curved. In the particular embodiment, the end of the wrought iron is initially twisted (see FIG. 8) and this end can now be placed in recess 16 with the enlarged portion 17 accommodating the wider twisted end of the wrought iron. Thus, in FIG. 9 the twisted end is placed within the recess and portion 17. The tool can then be clamped in position and the length of wrought iron can be bent about the periphery of the raised portion 14 (see FIGS. 10-11) to form a decorative curve.

FIGS. 12-13 show how a length of wrought iron 19 can be placed in the larger recess 13 in the side wall of the tool, and with the tool clamped in position, a wrench can be used to place a twist in the wrought iron immediately adjacent the tool and therefore a twist can be placed anywhere along the length of the wrought iron merely depending on the position of the wrought iron in the tool. Also, several twists can be made in the length of the wrought iron.

If desired, the tool may be strengthened or hardened to reduce wear and in one form this can be done using steel inserts or cover members (not illustrated) that can be placed in the recesses or in any suitable position.

Throughout the specification and the claims (if present), unless the context requires otherwise, the term "comprise", or variations such as "comprises" or "comprising", will be understood to apply the inclusion of the stated integer or group of integers but not the exclusion of any other integer or group of integers.

Throughout the specification and claims (if present), unless the context requires otherwise, the term "substantially" or "about" will be understood to not be limited to the value for the range qualified by the terms.

It should be appreciated that various other changes and modifications can be made to any embodiment described without departing from the spirit and scope of the invention.

The invention claimed is:

1. A tool to manipulate a length of wrought iron, said tool comprising:

a) a top face, a bottom face, and at least one side wall, b) said side wall containing a recess, c) said recess comprising a channel which extends across said side wall and is sufficiently wide and deep to accommodate the length of wrought iron, while a twisting motion is imparted thereto, d) said top face and said bottom face being provided with differently sized raised portions having different radii and heights, e) the outer peripheries of the raised portions on said top face and said bottom face providing bending surfaces for the length of wrought iron, f) each of said raised portions further containing a recess with an enlarged inner surface adapted to trap an end of the length of wrought iron whereby the length of wrought iron can be bent around the periphery of the raised portion to form a decorative curve.

2. The tool as defined in claim 1 wherein said channel includes a smaller, elongated slot adapted to trap an end of the length of wrought iron so that a twisting motion imparted thereto forms a decorative twist in the end portion of the length of wrought iron.

3. The tool as claimed in claim 2 wherein the decorative twist in the end portion of the length of wrought iron fits into said enlarged portion of said recesses within said raised portions on said top face and said bottom face.

4. The tool as claimed in claim 1, which is able to manipulate wrought iron having a width of between 5-20 mm and a thickness of between 1-10 mm.

5. The tool as claimed in claim 1, comprising a pair of opposed faces which are rectangular when viewed in plan and which have a length of between 5-30 cm and a width of between 5-30 cm.

6. The tool as claimed in claim 5, wherein the opposed faces are spaced apart by a distance of between 1-10 cm.

7. The tool as claimed in claim 1, wherein the side wall has a width of between 1-10 cm.

8. The tool as claimed in claim 1, wherein the recess in the side wall is able to locate an intermediate portion of the wrought iron and/or an end of the wrought iron.

* * * * *